United States Patent [19]

Shyu

[11] Patent Number: 5,069,448

[45] Date of Patent: Dec. 3, 1991

[54] STOMACH EXERCISE DEVICE

[76] Inventor: Wen-Bin Shyu, No. 10, Lane 627, Sec. 4, Chung-Ching Rd., Ta-Ya Hsiang, Taichung Hsien, Taiwan

[21] Appl. No.: 623,320

[22] Filed: Dec. 6, 1990

[30] Foreign Application Priority Data

Oct. 4, 1990 [TW] Taiwan ..... 79211015

[51] Int. Cl.[5] ..... A63B 21/00

[52] U.S. Cl. ..... 272/130; 272/93

[58] Field of Search ..... 272/141, 116, 93, 120, 272/130, 137, 138

[56] References Cited

U.S. PATENT DOCUMENTS 3,638,941 2/1972 Kulkens ..... 272/142

4,351,527 9/1982 Crisp ..... 272/141

4,863,162 9/1989 Neckmann ..... 272/137

*Primary Examiner*—Richard J. Apley

*Assistant Examiner*—J. Donnelly

*Attorney, Agent, or Firm*—Townsend and Townsend

[57] ABSTRACT

A stomach exercise device includes a pneumatic cylinder incorporating a piston and a handled piston rod. The bottom of the pneumatic cylinder is movably connected to a base through a universal joint which permits the pneumatic cylinder to turn relative to the base. The base can be positioned beneath the two thighs of a sitting exerciser while he moves the piston rod up and down or turn it to and fro so as to alternately bent and straighten or twist the upper portion of his body.

4 Claims, 4 Drawing Sheets

STOMACH EXERCISE DEVICE

BACKGROUND OF THE PRESENT INVENTION

1. Related Field of the Present Invention

This invention relates to a stomach exercise device, and particularly to a pneumatic stomach exercise device having an air cylinder incorporating a piston and mounted on a base by means of a universal joint, the base being used to be positioned beneath the two thighs of the exerciser while the exerciser is sitting.

2. Brief Description of Related Prior Art

In common practice, people exercise their stomach by twisting to and fro or alternately bending and straightening at the waist. Various exercise devices are available for stomach exercises. Some of them are used for a twisting exercise and some are used for a bending and straightening exercise.

A common stomach exercise device is one which is comprised of extension springs. In operation, the user sits, positions one end of the device at his/her legs and holds the other end to alternately pull the springs and let them return by their resilient forces. This operation causes the user to alternately bend at the waist and straighten his body. A disadvantage of this device is that the device does not permit the user to vary its use according to his physical condition.

SUMMARY OF THE INVENTION

An object of the present invention is to provide a pneumatic stomach exercise device which can be easily adjusted to permit the user to employ different exercising forces depending on his/her endurance.

Another object of the invention is to provide a pneumatic stomach exercise device which can be used for both twisting exercise and bending and straightening exercise.

According to the present invention, a stomach exercise device comprises: a base having a dimension sufficient to be positioned beneath two thighs of a sitting person; a cylindrical housing having a bottom closed end; a universal joint connected to both the base and the bottom closed end; a piston member disposed in the cylindrical housing and confining a gas chamber with the cylindrical housing; a piston rod attached to the piston member and having an upper end provided with a handle; and a valve means attached to the cylindrical housing near the bottom closed end to regulate the air flowing into the cylindrical housing.

The present exemplary preferred embodiment will be described with reference to the accompanying drawings, in which:

DETAILED DESCRIPTION OF THE PREFERRED EMBODIMENT

Figure 1:
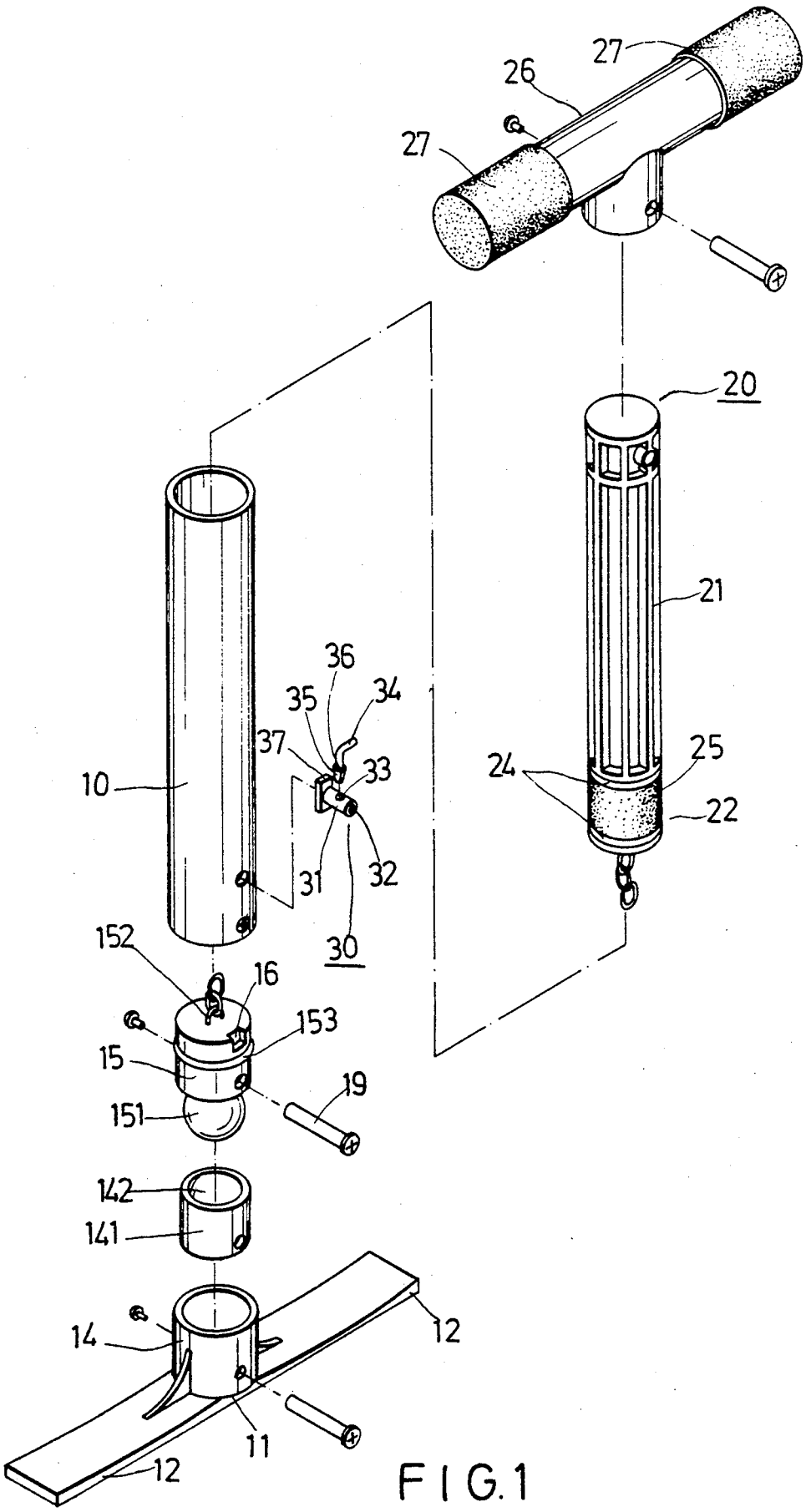
FIG. 1 is an exploded view of a stomach exercise device embodying the present invention.
Figure 2:
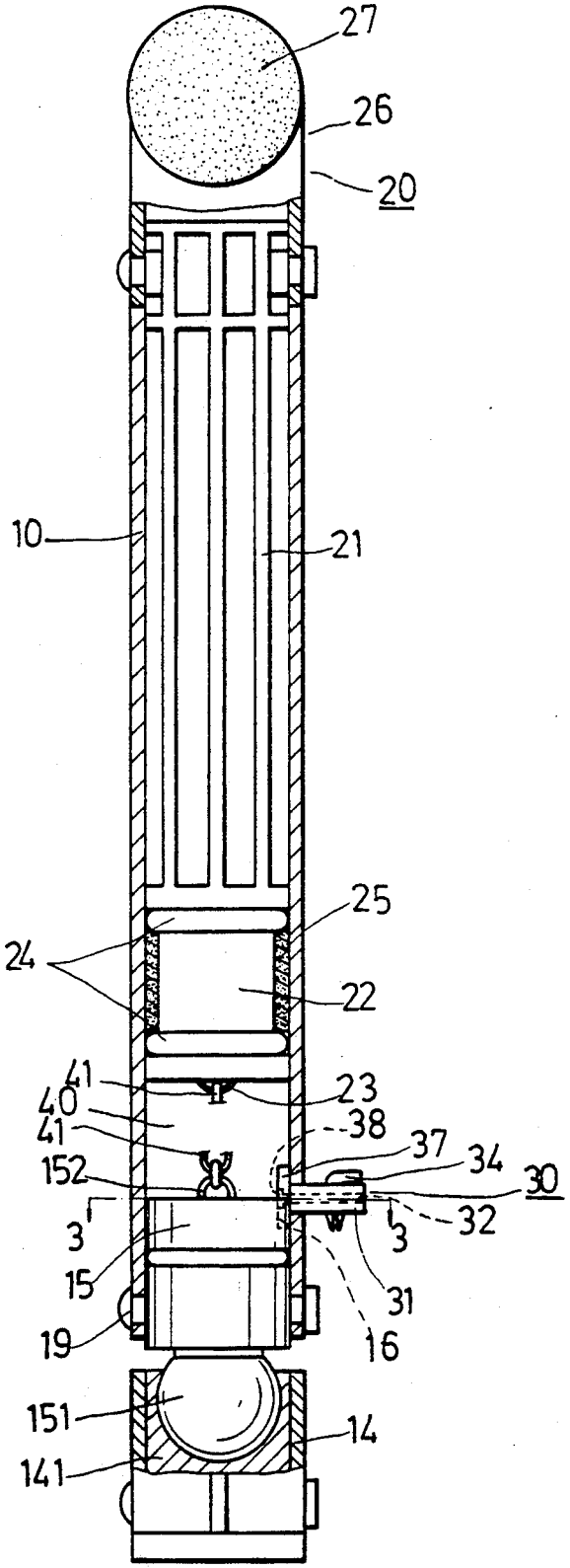
FIG. 2 is a sectional view of the exercise device of FIG. 1.
Figure 3:
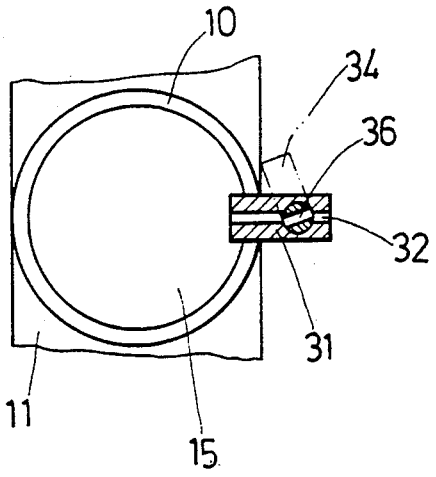
FIG. 3 is a sectional view taken along line 3—3 of FIG. 2.
Figure 4:
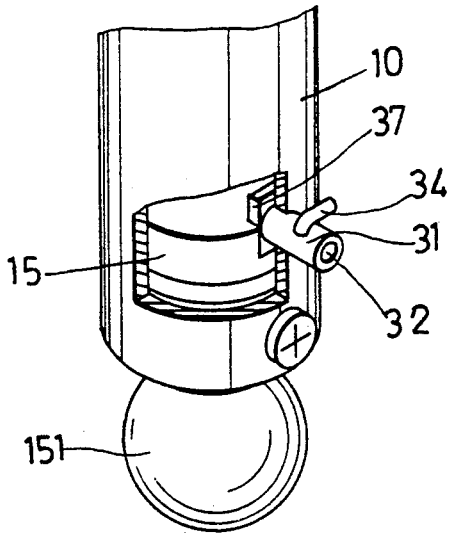
FIG. 4 is a fragmentary view of the exercise device of FIG. 2.

Referring to FIGS. 1 to 4, a stomach exercise device embodying the present invention comprises a cylindrical housing 10, a manipulation unit 20, a valve means 30 and a stop means 40.

The cylindrical housing 10 is mounted on a base 11 having two opposite positioning portions 12 to be placed beneath the thighs of the user while the user is sitting. A cylindrical seat 14 projects from the base 11 and securely receives a cylindrical joint body 141 having a concavity 142. A plug body 15 has a bottom joint ball 151 engaging the concavity 142, thereby movably connecting the plug body 15 to the seat 14 and permitting the cylindrical housing 10 to turn relative to the base 11.

The lower end of the cylindrical housing 10 is sleeved on and screwed to the plug body 15 by means of a screw 19. The plug body 15 is provided with a sealing ring 153 to provide a gas tight seal between the wall of the cylindrical housing 10 and the plug body 15. The plug body 15 further has a recess 16 above the sealing ring 153.

The manipulation unit 20 has a piston rod 21 inserted into the cylindrical housing 10 and a piston member 22 at the lower end of the piston rod 21. Two sealing rings 24 and a foamed member 25 are provided around the piston member 22. The foamed member 25 is used to absorb a certain amount of lubricating oil. A handle 26 which has two grip portions 27 is attached to the top end of the piston rod 21.

The valve means 30 is attached to the lower portion of the cylindrical housing 10 and includes a tubular member 31 with an attachment piece 37 positioned in the notch 16 of the plug body 15. The tubular member 31 is communicated with the interior of the cylindrical housing 10 through an opening 38 of the attachment piece 37. Air can enter the cylindrical housing 10 through the tubular member 31. A cork 34 is rotatably inserted in a radial hole 33 of the tubular member 31 to close and open the bore 32 of the tubular member 31. The cork 34 has a bottom resilient split portion 35 so that the cork 34 can be fitted in the tubular member 31 by pinching and inserting the split portion 35 and can be prevented from being released therefrom by the straightening action of the split portion. A small hole 36 is provided in the cork 34 so that the bore 32 of the tubular member 31 can be fully closed, fully opened or partially opened by turning the cork 34.

The stop means 40 is used to prevent the piston rod 21 from being released from the cylindrical housing 10. Its includes a chain 41 whose one end is connected to a lug 23 of the piston member 22 and whose another end is connected to a lug 152 of the plug body 15.

Figure 5:
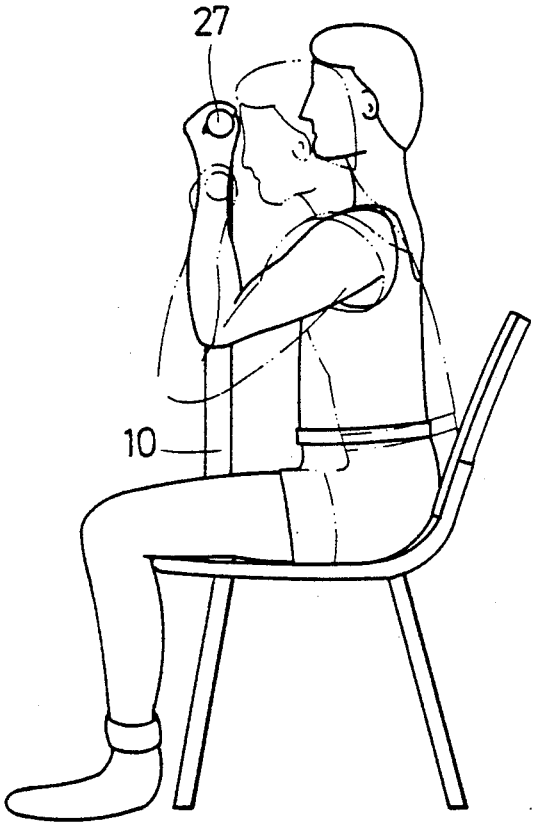
FIG. 5 shows the operation of the exercise device of the present invention.

Referring to FIG. 5, during the exercising operation, the user sits on a chair with the positioning portions 12 of the base 11 beneath his thighs. The handle 26 is moved upward and downward or turned to and for by the user. When the handle 26 is moved upward, air is pumped into the cylindrical housing 10. When the handle 26 is moved downward, air is expelled from the cylindrical housing 10. The user alternately bends and straightens as well as twists the upper portion of his body when turning or moving the handle 26 upward and downward, thereby exercising his abdomen.

The pressure of the air in the cylindrical housing can be adjusted by turning the cork 34 to regulate the inlet and outlet of the air. If the cork 34 is in a fully closing position, the air pressure in the device is the highest. If the cork 34 is in the fully open position, the air pressure is the lowest. By simply turning the cork 34, the device can be adjusted to accommodate the physical endurance/condition of a user.

With the invention thus explained, it is apparent that numerous modifications and variations can be made without departing from the scope of the invention. It is therefore intended that the invention be limited only as indicated in the appended claims.

I claim:

1. A stomach exercise device comprising:

a base having a dimension sufficient to be positioned beneath two thighs of an exerciser who is sitting; said base including a hollow cylindrical seat and an elongated plate fixed to said hollow cylindrical seat and having two end portions extending in diametrically opposite directions;

a cylindrical housing having a bottom closed end;

a universal joint connected to both said base and said bottom closed end; said universal joint including a ball member attached to said bottom closed end of said cylindrical housing and a cylindrical body fixedly fitted in said hollow cylindrical seat, said cylindrical body having a concavity to receive and engage said ball member;

a piston member disposed in said cylindrical housing and confining a gas chamber with said cylindrical housing;

a piston rod attached to said piston member and having an upper end provided with a handle; and a valve means attached to said cylindrical housing near said bottom closed end to regulate the air flowing into the cylindrical housing.

2. A stomach exercise device as claimed in claim 1, further comprising a stop member to prevent said piston rod from being released from said cylindrical housing, said stop member having a chain with one end connected to said bottom closed end and the other end connected to said piston member.

3. A stomach exercise device as claimed in claim 2, wherein said handle is a rod having an intermediate portion connected to said piston rod and two end portions each with a grip portion.

4. A stomach exercise device as claimed in claim 3, wherein said valve means includes a cork turnable among a fully closed position, a fully open position and a partially open position.

* * * * *